United States Patent [19]

Haas

[11] 4,301,640

[45] Nov. 24, 1981

[54] CONTAINER CLOSING MEANS AND PROCESS

[75] Inventor: Richard G. Haas, South Haven, Mich.

[73] Assignee: Brown Company, Kalamazoo, Mich.

[21] Appl. No.: 92,689

[22] Filed: Nov. 9, 1979

[51] Int. Cl.[3] ..... B67B 1/04; B65B 7/28

[52] U.S. Cl. ..... 53/478; 53/486; 53/488; 53/330; 156/69

[58] Field of Search ..... 53/329, 330, 478, 486, 53/488, 489, 383, 333, 551; 156/69

[56] References Cited

U.S. PATENT DOCUMENTS

| | | | |
|---|---|---|---|
| 2,752,744 | 7/1956 | Pechy | 53/330 |
| 3,679,509 | 7/1972 | Fielibert | 53/478 X |
| 3,961,463 | 6/1976 | Dimond | 53/330 X |
| 4,040,237 | 8/1977 | O'Brien | 53/551 |

*Primary Examiner*—Horace M. Culver
*Attorney, Agent, or Firm*—Gordon W. Hueschen

[57] ABSTRACT

A machine and process useful for fastening a closure member to a container with an upstanding tubular wall, an end edge of which is folded over onto itself to form a folded-over, reinforced portion of double thickness at that end, the closure member having an upstanding tubular inner wall conforming to the inner surface of the folded-over, reinforced portion and a downstanding tubular outer wall connected thereto and conforming to the outer surface of the folded-over, reinforced portion, thereby forming a tubular channel in which the folded over, reinforced portion is seated in frictional engagement, which comprises a dish-shaped fastening head adapted to be positioned around the closed end of the container between the jaws of a pincer, one end of which comprises a punching point and the other of which comprises an anvil, and a wedge or a wedging toggle arranged to wedge a plurality of said punching points into selected portions of the upstanding tubular inner wall of the channel into the inner surface of the folded-over, reinforced portion against the anvils on the opposed jaws. The wedge or toggle is designed to give a mechanical advantage of at least two and to engender a pressure on the selected portions pinched-in by the jaws sufficient to cause hot melt adhesive to flow in or through cut areas in the folded-over portion and to seal the cover thereto without application of extraneous heat.

11 Claims, 9 Drawing Figures

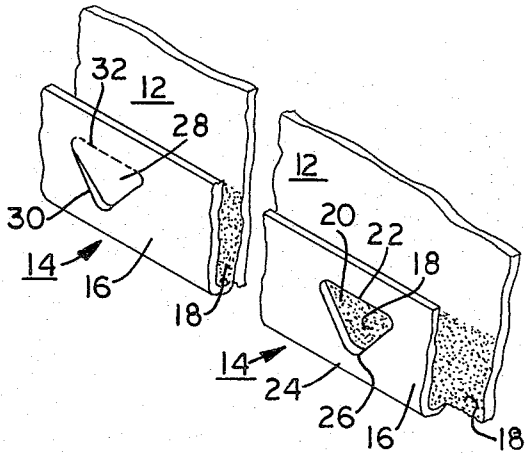
FIG. 8
FIG. 7
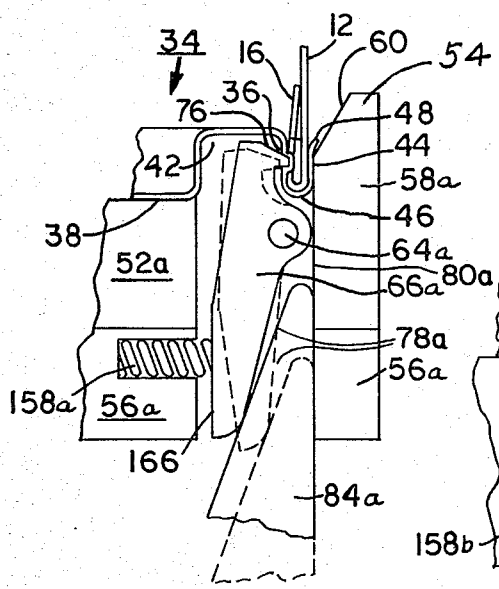
FIG. 2
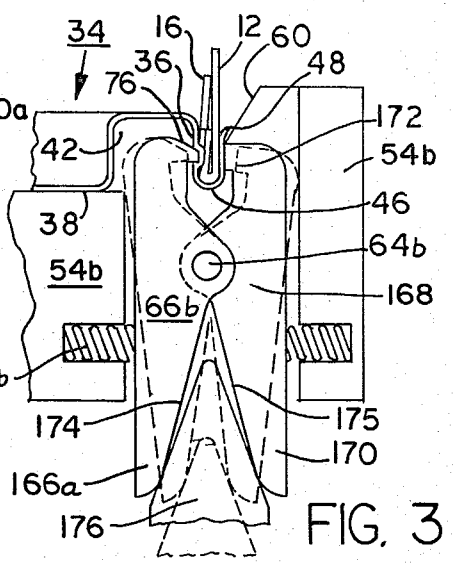
FIG. 3
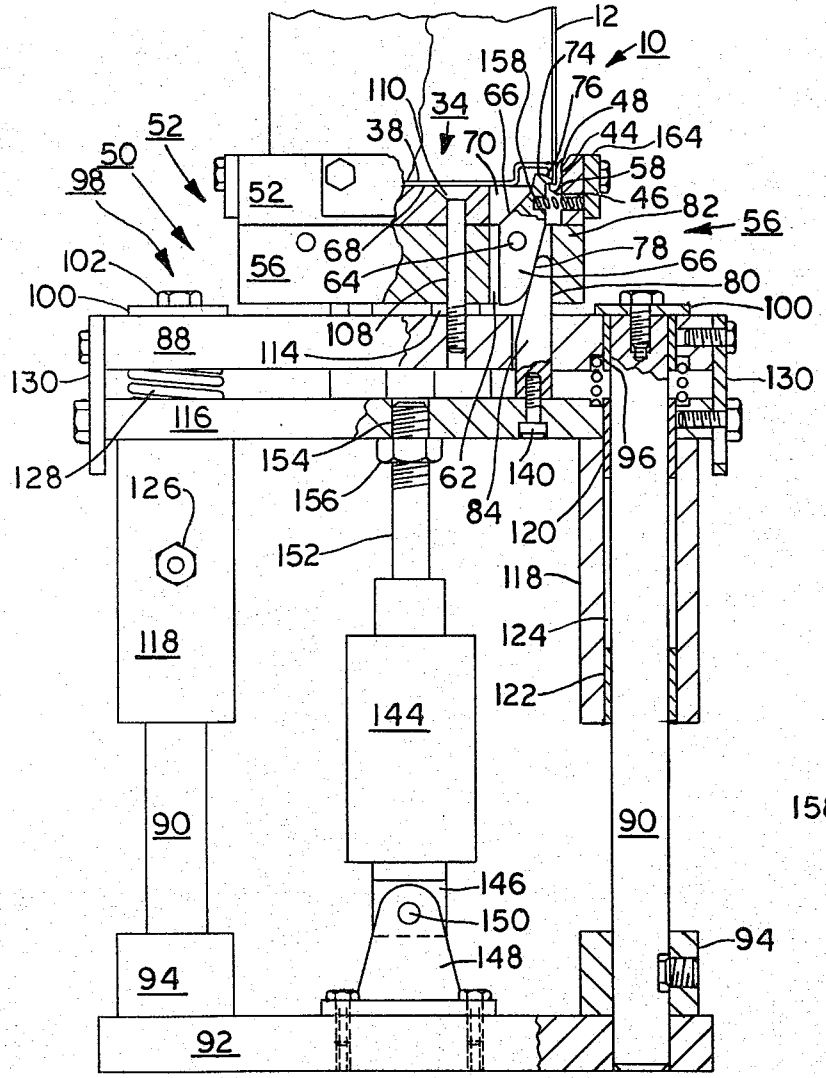
FIG. 1

CONTAINER CLOSING MEANS AND PROCESS

FIELD OF THE INVENTION AND PRIOR ART

This invention relates to improvements in the machine and process disclosed in my copending U.S. application Ser. No. 71,243, filed Aug. 30, 1979, which is useful for fastening a closure member to a container with an upstanding tubular wall, an edge of which is folded over onto itself to form a folded-over, reinforced portion of double thickness at that end, the closure member having an upstanding tubular inner wall conforming to the inner surface of the folded-over, reinforced portion and a downstanding tubular outer wall connected thereto and conforming to the outer surface of the folded-over, reinforced portion, thereby forming a tubular channel in which the folded-over, reinforced portion is seated in frictional engagement, which container is particularly adapted for the packaging of ice cream and the like.

The disclosure of the above-identified copending application is incorporated herein by reference.

The machine and process of the above-identified copending application has the disadvantage that the means for sealing the closure to the container has a low mechanical advantage, so that the pressure applied to the sealing can only be increased by increasing the size and capacity of the pressure-applying means. Also, the prior device and process requires the application of heat to cause the hot melt adhesive to flow and adhere to the juxtaposed wall of the channel of the closure assembly.

OBJECTS OF THE INVENTION

It is an object of the invention to provide an improved machine and process of the class described. It is a further object of the invention to provide a closure sealing means which has a relatively-high mechanical advantage, so that pressure-applying means of relatively-small power capacity is capable of engendering relatively-high pressure at the sealing situs. It is a further object of the invention to provide a machine and process of the class described in which a seal can be effected with hot melt adhesive without the application of extraneous heat.

BRIEF DESCRIPTION OF THE INVENTION the invention relates to a machine useful for fastening a closure member to a container with an upstanding tubular wall, an end edge of which is folded over onto itself to form a folded-over, reinforced portion of double thickness at that end, the closure member having an upstanding tubular inner wall conforming to the inner surface of the folded-over, reinforced portion and a downstanding tubular outer wall connected thereto and conforming to the outer surface of the folded-over, reinforced portion, thereby forming a closure assembly comprising a tubular channel in which the folded-over, reinforced portion is seated in frictional engagement, which machine comprises pinching means for pinching together selected portions of said closure assembly comprising punching-point means and anvil means disposed on opposed portions of the jaws of a pincer-like means; container-positioning means for positioning the closure assembly with the tubular channel disposed between the jaws of the pincer-like means, with the upstanding wall thereof opposed to one of the punching-point means and said anvil means and the downstanding wall thereof opposed to the other; and, pinching means for moving the jaws to pinching position, comprising wedging means acting on the pincer-like means to close the jaws and to cause the wall portions of the tubular channel at the selected portions of the closure assembly to be pinched into the folded-over, reinforced portion in the channel and pressure-applying means acting on the wedging means to cause it to exert pressure on the pinching means and through the same on the pinched-in portions of the closure assembly, the pinching means having a mechanical advantage of at least 2, whereby the traverse of the pressure-applying means is at least two times the traverse of the punching-point means toward the anvil means.

Advantageously, the punching-point means is disposed so that, in punching position, it is opposed to the upstanding wall of the tubular channel and the anvil means is opposed to the downstanding wall of the tubular channel. Preferably, the anvil means is fixed relative to the downstanding wall, and the machine base and the punching-point means is movable toward and away from the upstanding wall and the anvil means.

Advantageously, also, the wedge-like means comprises a toggle linked to the punching-point means and to the pressure-applying means, with the toggle disposed at an angle which gives the desired and specified mechanical advantage. Alternatively, the wedging means comprises a cam surface on the punching-point means and a cam on the pressure-applying means acting at an angle which gives the desired and specified mechanical advantage.

It is sometimes desirable to have the face of the punching-point means serrated, ribbed, or roughened, so that it will more effectively bite into the wall of the channel. Desirably, the anvil means, especially if it is disposed opposite the outside wall of the channel, is smooth, in order to provide a minimum of scarring. Advantageously, for the same reason, it is desirable that the area of the face of the anvil means be considerably larger than the area of the face of the punching-point means.

The invention is particularly directed to a machine for fastening a closure member to a container of the class described in which the folded-over portion having between it and the main wall of the container hot melt adhesive and cut areas through which the hot melt adhesive can reach the juxtaposed wall of the tubular channel, which machine has pinching means for pinching together portions of the closure assembly opposed to the cut areas comprising wedging means for wedging a punching-point means into the wall portions of the channel opposed the cut areas against an anvil means and pressure-applying means acting on said wedging means and having a capacity to cause the pinching means to exert pressure on the pinched-in portions sufficient to cause the hot melt adhesive to flow and adhere to the juxtaposed wall of said channel without the application of heat other than that engendered by the pressure applied. Advantageously, the wedging means comprises a toggle linked to the punching-point means and to the pressure-applying means, with the toggle disposed at an angle which gives the desired and specified mechanical advantage.

Also, the invention is particularly directed to a process for fastening a closure member to a container with an upstanding tubular wall, an end edge of which is folded over onto itself to form a folded-over, reinforced portion of double thickness at that end, the closure member having an upstanding tubular inner wall conforming to the inner surface of said folded-over, reinforced portion and a downstanding tubular outer wall connected thereto and conforming to the outer surface of said folded-over, reinforced portion, thereby forming a closure assembly comprising a tubular channel in which the folded-over, reinforced portion is seated in frictional engagement, the folded-over portion having between it and the main wall of the container hot melt adhesive and cut areas through which the hot melt adhesive can reach the juxtaposed wall of the tubular channel, which process comprises pinching together portions of the closure assembly opposed to the cut areas by wedging a punching-point means into the wall portions of said channel opposed to the cut areas and applying sufficient pressure to cause the hot melt adhesive to flow and adhere to the justaposed wall of the channel without the application of heat other than that engendered by the pressure applied.

BRIEF DESCRIPTION OF THE DRAWINGS

In the drawings:

FIG. 1 is a side elevation, partly in section, of a machine of the class described.

FIG. 2 is a detail view of FIG. 1.

FIG. 3 is a detail view of a modification of FIG. 2.

FIG. 7 is a detail view of the container.

FIG. 8 is a detail view of a modification of FIG. 7.

DETAILED DESCRIPTION OF THE INVENTION

Figure 6:
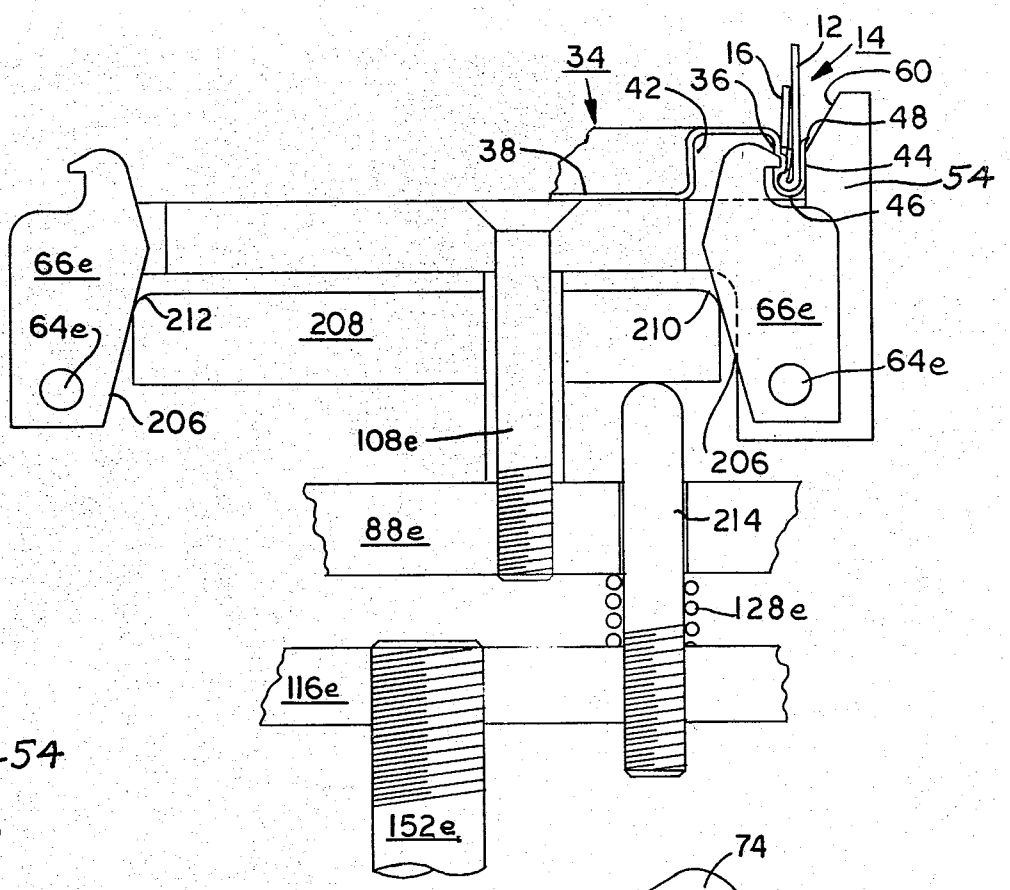
FIG. 6 is a detail view of yet another modification.

Referring now to the drawings, 10 designates a container of the class described. This container has an upstanding tubular wall 12 comprised of four flat sides and having a rectangular cross-section. The bottom of the container 10 is closed by any suitable closure means, such as flaps, in a manner already well known in the art.

The top edge of the container wall 12 (shown in the down position in these figures) is folded over onto itself to provide a portion 14 of double thickness. The folded-over portion 16 is glued to the upstanding wall 12 by means of a strip of hot-melt adhesive 18. Application of heat to the folded-over portion 16, accompanied by pressure to hold the folded-over portion 16 flat against the wall 12, causes the folded-over portion 16 to adhere to the wall 12 to form a folded-over, reinforced portion of double thickness.

In a preferred form of the invention, as shown in FIG. 7, the folded-over portion 16 has cut-out portions 20, advantageously, of triangular shape, with bases 22 generally parallel with the edge 24 of the reinforced portion, and with the apex 26 adjacent to but spaced from the edge 24. Alternatively, as shown in FIG. 8, the folded-over portion 16 may have cut portions 28 which, too, advantageously, are triangular in shape and oriented as the triangular cut-out portions 20. These portions are cut along the legs 30 of the triangle, leaving the base 32 intact. The cut-out portions 20 and the cut portions 30 constitute cut areas, the purpose of which will be described hereinafter.

The one end of the container is closed by a friction-type closure preferably made of a plastic material, advantageously, a thermoplast. It comprises a top member 34 having an upstanding tubular inner wall 36 shaped to frictionally engage the inner surface of the folded-over portion 16 of the container wall 12. If desired, the closure member 34 may have a centrally-located upwardly-domed portion 38, the outer wall 40 of which is spaced from the upstanding wall 36 to form a tubular channel 42 adapted to receive portions of the fastening mechanism yet to be described.

The closure member 34 also has a downstanding tubular outer wall 44 connected to the upstanding wall 36 by a bight 46. The downstanding wall 44 is shaped to frictionally engage the outer surface of the container wall 12 and forms with the downstanding wall 36 a tubular channel which receives the folded-over, reinforced portion 16 in frictional engagement, as shown in FIGS. 2–6. The downstanding outer wall 44 has an outwardly-flaring portion 48 to facilitate placing the closure member 34 on the container wall 12.

In this modification of the invention, the machine comprises a fastening head 50 having a dish-shaped positioning member 52 having an upstanding tubular wall 54 and a yoke member 56 fastened to the bottom thereof. The upstanding tubular wall 54 has a vertical portion 58 conforming in shape and size to the downstanding tubular outer wall 44 of the closure member 34 so that, when the container closure member 34 is seated in positioning member 52, the downstanding tubular outer wall is juxtaposed to the vertical portion 58 of the upstanding wall 54, which functions as an anvil, for a purpose to be more fully described. The upstanding wall 54 has a flared-out portion 60 for the purpose of guiding the closed container into the positioning member 52.

The yoke member 56 comprises a plurality of yokes 62, two of which are disposed on each side and one on each end. Each yoke 62 has a transverse bore for receiving pivot pin 64 on which are mounted finger 66. The bottom 68 of the positioning member 52 is provided with apertures 70 conforming essentially to the shape of the yoke 62, through which apertures fingers 66 project axially upwardly.

Figure 9:
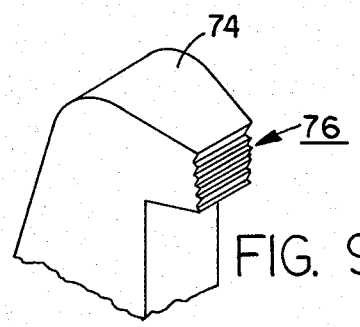
FIG. 9 is a detail view of the punching head.

At the upper end of the fingers 66 are punching heads 74, the punching points 76 of which are apposed to the vertical portions 58 of the wall 54 and apposed to the upstanding wall 36 of the closure member 34 when the container is seated in the positioning means 52. Fingers 66 have a downwardly and inwardly sloping cam surface 78 opposed to the inner surface 80 of the outer wall 82 of yoke member 56 which forms an acute angle with the cam surface 78 for a purpose to be described. A wedge-shaped cam 84 is adapted to be wedged between surfaces 78 and 80 to force the punching points 76 into punching contact with the upstanding wall 36 against the vertical portion 58 of the upstanding wall 54, which vertical portion functions as an anvil for the punching points 76 to punch against. The punching head 74 tapers to the punching points 76 and, advantageously, has a serrated face, as best seen in FIG. 9. When the closed container is seated in the positioning member 52, the punching points 76 are opposite the cut areas 20 or 28 and, when the punching head 74 is actuated by the wedge-shaped cam 84, the punching points 76 punch the apposed portion of the upstanding wall 36 of the cover member 34 into the cut areas 20 or 28.

The fastening head 50 is mounted on a first transverse platform 88 which is mounted for reciprocation on the vertical rods 90 which are mounted on a fixed base 92 in collars 94 welded thereto. The first transverse member 88 is provided with bushings 96 to facilitate its sliding up and down on the rods 90 and is prevented from going off the top of the rods by stops 98 comprising the washer 100 and the bolt 102.

For the purpose of this mounting, the positioning member 52 and the yokes 62 are provided with a plurality of axial bores for receiving the bolts 108. The heads 110 are countersunk to be flush with the bottom 68. The bolts 108 are threaded into the first transverse platform 88 and pass through spacers 114 for the purpose of keeping the yoke member 56 out of contact with the first transverse platform 88.

A second transverse platform 116 is mounted for reciprocation on the rods 90. It has affixed thereto depending tubular members 118 which are provided with upper and lower bushings 120 and 122, leaving between them space 124 into which a lubricant can be introduced through the fitting 126.

Between the two transverse platforms 88 and 116 are spring members 128 which tend to force the second transverse platform 116 downwardly away from the first transverse platform 88. A lost-motion connection 130 connects the two platforms together.

Fastened to the second transverse 116 are the wedge-shaped cams 84. They are adapted to be bolted to, or otherwise fastened, to transverse platform 116, as shown at 140.

Between the base member 92 and the second transverse platform 116 is pressure-fluid cylinder 144, the cylinder of which is fastened to the base member 92 by a tenon 146 pivoted in the yoke 148 by pivot pin 150. The piston rod 152 is affixed to the second transverse platform 116. Suitably, it has a threaded end 154 which is threaded into the second transverse platform 116 and secured thereto by lock nut 156.

The fingers 66 are spring-pressed to retracted position by means of spring members 158 which pass through bores in wall 54 into shallow bores in the fingers 66. These spring members are held in position by plates 164 bolted to the upstanding wall 54.

In the operation of the above-described machine, a container 12, with its closure member 34 down, is positioned above the fastening head 50 by a suitable conveyor and/or positioning means, not shown. The fluid-pressure cylinder 144 is now actuated, causing the two platforms 88 and 116 to move upwardly as a unit. This causes the positioning member 52 to move up around the closure member 34 to the position shown, in contact with the domed portion 38 and with the downstanding tubular outer wall 44 of the cover member 34 engaged against the vertical anvil portion 58 and with the punching points 76 apposed to the upstanding tubular inner wall 36 and opposite the cut areas 20 and 28.

As further upward movement of the first transverse platform 88 is terminated by the stop means 98, further upward movement is confined to platform 116. This causes the wedge-shaped cam 84 to move up into the V between the cam surface 78 and the inner surface 80. Further upward movement then causes the fingers 66 to rotate about their pivots 77 and to wedge the punching points 76 into the upstanding tubular inner wall 36, where they are held until the hot melt adhesive flows into contact with the deformed portion of the upstanding wall 38 and a seal is effected between the upstanding wall 38 and the cut areas 20 or 28.

The slope of the cam surface 78, relative to the inner surface 80, is sufficiently acute as to provide a mechanical advantage of at least 2, that is to say, a mechanical advantage such that the traverse of the wedge-shaped cam 84 is at least twice the traverse of the punching points 76 toward the anvil 58. This makes it possible to apply a great leverage to the punching points 76 and to engender a pressure in the portions of the cover container assembly pinched between the punching points 76 and the anvil wall 58 sufficient to cause the hot melt adhesive to flow into contact with the upstanding wall 36 of the tubular channel and to adhere thereto.

Then, the operation is reversed, whereupon the wedge-shaped cam 84 is retracted and the springs 158 move the punching heads 74 radially inwardly and withdraw the punching points 76 from engagement with the upstanding tubular inner wall 36. The container 12, with its closure member 34 thus fastened thereon, is then moved out of position and a new unfastened container moved in. After the closure member has been fastened in place, the container is moved onto a filling station where it is filled with ice cream, or the like, and the bottom then closed in a manner already known in the art.

In the modification of FIG. 2, the pivot **64*a* has been moved up into the member 52, thus increasing the leverage on the punching point 76, and the spring 158*a* has been placed in a bore in the yoke member 56*a* and presses on the tail 166 of the finger 66*a*. Thus, when the wedge-shaped cam 84*a* moves up into engagement with the cam surface 78*a* (it rides up in engagement with the inner wall surface 80*a*), still more leverage is exerted on the punching point 76** and an increased mechanical advantage is obtained. Comparison of the positions shown in the dotted and solid lines shows that the traverse of the cam is several, perhaps as much as at least 5, times as great as the traverse of the punching point.

In the modifications of FIGS. 1 and 2, the punching points and the anvil means are on opposed jaws of a pincer, one of which, the anvil, is fixed. In the modification of FIG. 3, both jaws of the pincer are movable. Thus, the member **54*b* serves as a positioning device to center the container in sealing position and the anvil is recessed therein and moves out toward the punching point. Thus, the anvil comprises a recessed arm 168 corresponding to the arm 66*b*, pivoting on a common pivot 64*b*. The arm 168 has a tail 170 corresponding to the tail 166*a* and an anvil head 172 corresponding to and opposed to the pinching point 76. The tails 166*a* and 170 have opposed cam surfaces 174 and 175 forming an acute angle. A wedge-shaped cam 176 is complementary to the cam surfaces 174 and 175. When the cam 178 moves upwardly, it engages the cam surfaces 174 and 175, as shown in the dotted lines, and wedges them apart to the position shown in solid lines. Here, again, a substantial mechanical advantage is obtained, although not as great as that obtained in FIGS. 1 and 2. This is a result of the need for moving the anvil means 168** out of engagement with the closure assembly. This disadvantage is somewhat offset by the ease with which the sealed container can be removed from the positioning device.

Figure 4:
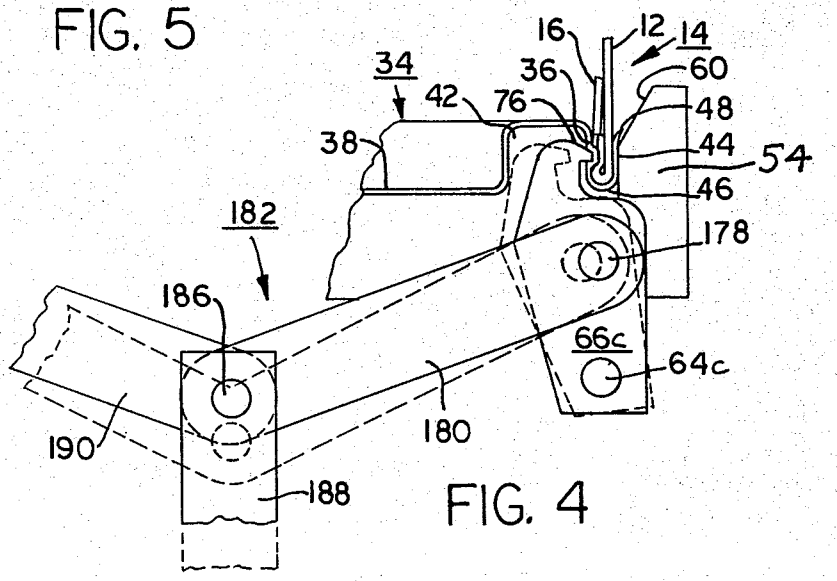
FIG. 4 is a detail view of another modification.

In FIG. 4, the wedge-shaped cam has been replaced by a wedging toggle joint 182, the legs of which are disposed to give the same wedging action as the wedge-shaped cams of FIGS. 1, 2, and 3. In this form, the arm **66*c* is pivoted on pivot 64*c*, as in FIG. 1. To this arm is pivoted at 178, one leg 180 of a toggle joint 182 which, in turn, is pivoted at 186 to a member 188, connected directly or indirectly to a pressure cylinder like 144 and to the other leg 190 of the toggle joint 182 which, in turn, is pivoted to a diametrically-opposed arm 66*c*, not shown. Thus, when the member 188 is moved up, the legs 180 and 190 move to the right and left and wedge the arms 66***c* into sealing position. If desired, the legs can be shortened, so that the toggle joint, in sealing position, is at or at least nearer the dead center position. In this way, the mechanical advantage can be increased to the point where extremely high pressures are obtained.

Figure 5:
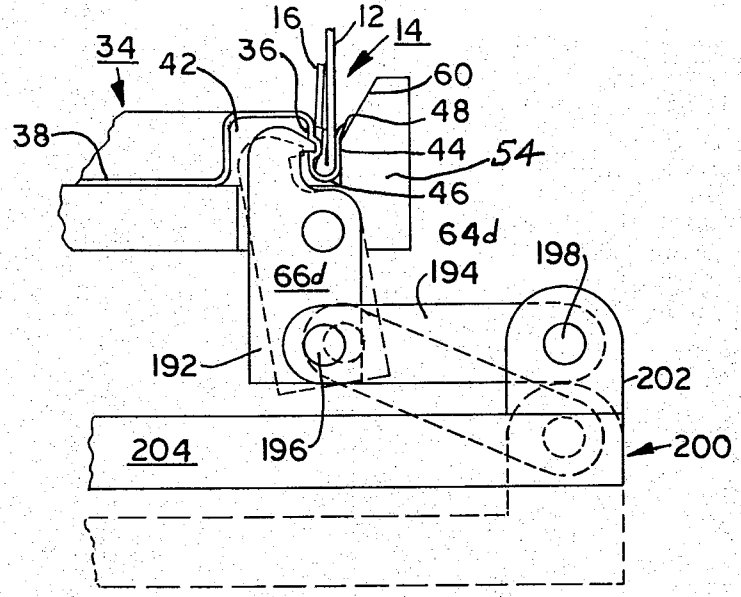
FIG. 5 is a detail view of still another modification.

In FIG. 5, the arm 66*d* is pivoted at 64*d*, as in FIG. 2. The tail 192 has a toggle link 194 pivoted at 196 thereto. The other end of the toggle link 194 is pivoted at 198 to a vertically-recoprocable member 200 which comprises arms 202 affixed to a transverse member 204 which are mounted in the machine as the transverse member 116 in FIG. 1. The link 194 is of such length as to reach a dead center position at the sealing position. Here, too, the relative positions shown in the dotted lines show a relatively great mechanical advantage. In the toggle mechanism of this figure and of FIG. 5, the mechanical advantage increases the nearer the device reaches dead center.

In the modification of FIG. 6, the arm 66*e* is pivoted at 64*e*, as in FIGS. 1 and 4. Each arm 66*e* has a cam surface 206 on the inner faces thereof, which slope upwardly and inwardly at an acute angle to the vertical. These cam surfaces are engaged by cam member 208 having camming corners 210 and 212. The cam member 208 is mounted for vertical reciprocation on the bolts 108*e* which fasten the member 52*e* to the transverse member 88, as in FIG. 1. The cam member 208 is mounted on top of rods 214 (only one is shown), which are anchored to the transverse member 116*e* like the wedge-shaped cam 84 of FIG. 1. The springs 128*e*, which press the two transverse members apart, are disposed around these rods. Thus, when the transverse member 116*e* moves upwardly toward the transverse member 88*e*, the rods 210 push the cam member 208 up into engagement with the cam surfaces 206 and wedge the two arms 66*e* apart, thus forcing the punching points 76 into the closure assembly, as previously described. Cam member 208 retracts by gravity or by being linked to the rods 214.

Springs, not shown, are provided to force the fingers back to non-engaging position. Like springs could be used to force the cam member 208 to retracted position. In FIGS. 4 and 5, such springs are not needed because positive retraction is effected by the toggle links.

In place of the horizontal serration in FIG. 9, there can be substituted other means for deep roughening the face of the punching points, such as, vertical or oblique serrations, knurling, dimpling, or like means, effective to cause the punching points to bite into the wall of the closure assembly. Such deep roughening of the face of the punching points stimulates the cold flow of the hot melt adhesive under the pressure applied.

It is to be understood also that rollers can be provided on the camming surfaces to reduce friction.

It is to be understood that the invention is not to be limited to the exact details of operation or structure shown and described, as obvious modifications and equivalents will be apparent to one skilled in the art.

I claim:

1. A machine useful for fastening a closure member to a container with an upstanding tubular wall, an end edge of which is folded over onto itself to form a folded-over, reinforced portion of double thickness at that end, said closure member having an upstanding tubular inner wall conforming to the inner surface of the folded-over, reinforced portion and a downstanding tubular outer wall connected thereto and conforming to the outer surface of said folded-over, reinforced portion, thereby forming a closure assembly comprising a tubular channel in which said folded-over, reinforced portion is seated in frictional engagement, which machine comprises:

pincer-like means for pinching together selected portions of said closure assembly comprising punching-point means and anvil means disposed on axially opposed portions of the jaws of said pincer-like means;

container-positioning means for positioning said closure assembly with said tubular channel disposed between the jaws of said pincer-like means and said anvil means, with the upstanding wall thereof opposed to one of the said punching-point means and the downstanding wall thereof opposed to the other; and, pinching means for moving said jaws to pinching position, comprising wedging means acting on said pincer-like means to close said jaws and to cause the wall portions of the tubular channel at said selected portions of said closure assembly to be pinched into the folded-over, reinforced portion in said channel and pressure-applying means acting on said wedging means to cause it to exert pressure on said pinching means and through the same on the pinched-in portions of said closure assembly.

2. A machine according to claim 1, in which said pinching means has a mechanical advantage of at least 2, whereby the traverse of said pressure-applying means is at least two times the traverse of said punching-point means toward said anvil means.

3. A machine according to claim 2, in which said punching-point means is disposed so that, in punching position, it is opposed to the upstanding wall of said tubular channel and said anvil means is opposed to the downstanding wall of the tubular channel.

4. A machine according to claim 3, in which said anvil means is fixed relative to said downstanding wall, and the machine base and said punching-point means is movable toward and away from said upstanding wall and said anvil means.

5. A machine according to claim 3, in which said wedging means comprises a toggle linked to the punching-point means and to said pressure-applying means, with said toggle disposed at an angle which gives the desired and specified mechanical advantage.

6. A machine according to claim 1, in which said punching-point means has a deep roughened face at the punching point thereof.

7. A machine according to claim 6, in which said anvil means has a smooth surface at the face thereof opposed to said downstanding wall.

8. A machine according to claim 1, in which said wedging means comprises a cam surface on said punching-point means and a cam on said pressure-applying means acting at an angle which gives the desired and specified mechanical advantage.

9. A machine useful for fastening a closure member to a container with an upstanding tubular wall, an end edge of which is folded over onto itself to form a folded-over, reinforced portion of double thickness at that end, said closure member having an upstanding tubular inner wall conforming to the inner surface of the folded-over, reinforced portion and a downstanding tubular outer wall connected thereto and conforming to the outer surface of said folded-over, reinforced portion, thereby forming a closure assembly comprising a tubular channel in which said folded-over, reinforced portion is seated in frictional engagement, said folded-over portion having between it and the main wall of the container, hot melt adhesive and cut areas through which said hot melt adhesive can reach the juxtaposed wall of said tubular channel, which machine comprises:

pinching means for pinching together portions of said closure assembly opposed to said cut areas comprising wedging means for wedging a punching-point means into the wall portions of said channel opposed to cut areas against an anvil means and pressure-applying means acting on said wedging means and having a capacity to cause said pinching means to exert pressure on the pinched-in portions sufficient to cause the hot melt adhesive to flow and adhere to the juxtaposed wall of said channel without the application of heat other than that engendered by the pressure applied.

10. A machine according to claim 9, in which said wedging means comprises a toggle linked to said punching-point means and to said pressure-applying means with said toggle disposed at an angle which gives a mechanical advantage of at least 2.

11. A process for fastening a closure member to a container with an upstanding tubular wall, an end edge of which is folded over onto itself to form a folded-over, reinforced portion of double thickness at that end, said closure member having an upstanding tubular inner wall conforming to the inner surface of the folded-over, reinforced portion and a downstanding tubular outer wall connected thereto and conforming to the outer surface of said folded-over, reinforced portion, thereby forming a closure assembly comprising a tubular channel in which said folded-over, reinforced portion is seated in frictional engagement, said folded-over portion having between it and the main wall of the container, hot melt adhesive and cut areas through which said hot melt adhesive can reach the juxtaposed wall of said tubular channel, which process comprises:

pinching together portions of said closure assembly opposed to said cut areas by wedging a punching-point means into the wall portions of said channel opposed to said cut areas; and, applying sufficient pressure to cause the hot melt adhesive to flow and adhere to the juxtaposed wall of said closure without the application of heat other than that engendered by the pressure applied.

* * * * *

UNITED STATES PATENT AND TRADEMARK OFFICE

CERTIFICATE OF CORRECTION

PATENT NO. : 4,301,640

DATED : November 24, 1981

INVENTOR(S) : Richard G. Haas

It is certified that error appears in the above—identified patent and that said Letters Patent is hereby corrected as shown below:

[57] ABSTRACT, line 10 & 11; "folded over" should read -- folded-over --
Sheet 2 of drawings, figure 5, reference numeral "64d";

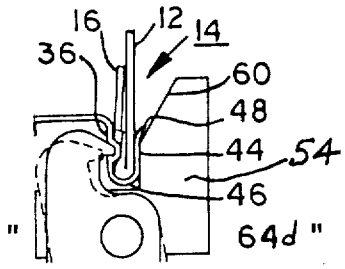

the reference numeral "64d" should be connected to the figure, like this;

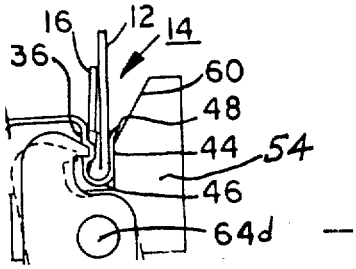

Col. 1, line 47; "the" should read -- The --
Col. 3, line 17; "justaposed" should read -- juxtaposed --
Col. 3, line 65; "one" should read -- open --
Col. 7, line 12; "recoprocable" should read -- reciprocable --

Signed and Sealed this

*Eighteenth* Day of *May 1982*

[SEAL]

*Attest:*

GERALD J. MOSSINGHOFF

*Attesting Officer*

*Commissioner of Patents and Trademarks*